United States Patent [19]

Bischofberger et al.

[11] 4,332,059

[45] Jun. 1, 1982

[54] DRIVE FOR DRAFTING ARRANGEMENT ROLLS OF LONG SPINNING MACHINES

[75] Inventors: Juerg Bischofberger, Neftenbach; Arthur Wuermli, Winterthur, both of Switzerland

[73] Assignee: Rieter Machine Works Limited, Winterthur, Switzerland

[21] Appl. No.: 196,912

[22] PCT Filed: Sep. 3, 1979

[86] PCT No.: PCT/EP79/00068

§ 371 Date: May 29, 1980

§ 102(e) Date: May 19, 1980

[87] PCT Pub. No.: WO80/00717

PCT Pub. Date: Apr. 17, 1980

[30] Foreign Application Priority Data

Sep. 29, 1978 [CH] Switzerland ..... 10175/78

[51] Int. Cl.[3] ..... D01H 1/22; D01H 13/14

[52] U.S. Cl. ..... 19/244; 19/293

[58] Field of Search ..... 19/236, 244, 258, 259, 19/260, 293

[56] References Cited

U.S. PATENT DOCUMENTS

| | | | |
|---|---|---|---|
| 2,480,936 | 9/1949 | Kershaw | 19/260 X |
| 2,810,165 | 10/1957 | Dunn et al. | 19/260 X |
| 2,911,782 | 11/1959 | Jackson et al. | 19/293 X |
| 2,962,771 | 12/1960 | Sapley | 19/260 X |

FOREIGN PATENT DOCUMENTS

| | | | |
|---|---|---|---|
| 531051 | 4/1954 | Belgium | 19/293 |
| 94895 | 5/1897 | Fed. Rep. of Germany | 19/244 |
| 2641434 | 3/1978 | Fed. Rep. of Germany | 19/244 |
| 2391297 | 12/1978 | France | 19/244 |
| 682798 | 11/1952 | United Kingdom | 19/293 |
| 822355 | 10/1959 | United Kingdom | 19/293 |

*Primary Examiner*—Louis Rimrodt

*Attorney, Agent, or Firm*—Werner W. Kleeman

[57] ABSTRACT

A drive for the rolls defining a main drafting zone of drafting arrangements of long spinning machines, wherein in order to prevent drafting defects caused by distortion movement of the rolls, the latter are driven from one end by a first gear arrangement and from the other end are interconnected rigidly drivewise or slippage-free, respectively, during the standstill of the spinning machine via a second gear arrangement and via a freewheel clutch.

5 Claims, 3 Drawing Figures

DRIVE FOR DRAFTING ARRANGEMENT ROLLS OF LONG SPINNING MACHINES

BACKGROUND OF THE INVENTION

The present invention concerns a drive for the driven drafting arrangement rolls of long spinning machines extending over the full length or over considerable parts of the length of the machine, preferably of ring spinning machines, in which the drafting arrangement rolls arranged on the same longitudinal side of the machine and defining a main drafting zone for the fibre slivers to be drafted, are mutually connected at one of their ends by first slippage-free transmission elements which effect the ratio of rotational speeds of these rolls determining the draft ratio.

With textile machines of this type there is a tendency, active since the very origins, to increase the number of working positions, e.g. of the spindles in the case of the ring spinning machine, driven by one single drive headstock. This tendency is prompted mainly by economic factors, as the increase in the number of working positions per machine results in a reduction of the price per working position, in a reduction of space per working position and in most cases, also in operating advantages.

One difficulty in achieving the above mentioned increase, however, is presented by the bottom rolls of the drafting arrangements of such machines, as in excessively long rolls the deformations caused by torsion can result in unacceptable working conditions. This concerns predominantly the rolls defining the main drafting zone of the drafting arrangement, i.e. e.g. the middle roll and the delivery roll of the double apron drafting arrangement, as widely used today on various spinning machines, preferentially on ring spinning machines, but also e.g. on the roving frame. In a main drafting zone of such type, the fibre mass is drafted to its final fineness before twist is imparted at a draft ratio of 10 fold and more, normally of about 30 fold. Any distortion, however small, of one roll active in the main drafting zone of a drafting arrangement with respect to the other roll immediately causes a considerable drafting defect resulting in a thick place and in a thin place in the drafted yarn. In many cases then very undesirable yarn breakages result. Experience with especially long spinning machines has shown, that the danger of distortion of the roll of the drafting arrangement is particularly great for the middle roll of a double apron drafting arrangement. Onto this roll, which as a rule also acts as a deflecting roll for the bottom apron of the double apron drafting arrangement, particularly strong braking forces act tangentially, which considerably exceed similar forces acting on the delivery rolls.

This difference is due to the rotational speed, which is reduced with respect to the delivery roll by the draft ratio, and due to the higher friction forces mainly generated by the apron which acts on this roll, and to the strong drafting forces acting on this roll in the predrafting zone. Due to these higher braking forces the middle drafting roll during the operation of the drafting arrangement thus is distorted to a higher degree than the delivery roll. If now the spinning machine is stopped, the forces acting tangentially upon the roll, and particularly the important drafting forces, are released to a large extent, in such manner that the input roll of the main draft zone, which is more distorted with respect to the delivery roll of the main drafting zone in the backward sense, tends to reverse this distortion and distort back in the normal sense of rotation. As the machine is thereafter started up, drafting defects generated in this manner already cause yarn breakages.

The situation described here for the drafting arrangement of the conventional spinning machine is further exacerbated in that during the subsequent start-up of the machine higher static friction forces are to be overcome by the input roll of the main drafting zone than by the delivery roll, which forces cause progressive distortion from the beginning of the input roll to its end. Also due to this distortion, the degree of which exceeds the distortion during normal operation, drafting defects and thus yarn breakages arise.

A reduction of the distortion mentioned by increasing the diameter of the rolls is excluded because of spinning technology requirements as an increase in diameter could be achieved only to the detriment of the quality of the fibre control during the drafting process.

Thus, it has been proposed already to avoid the above mentioned disadvantage of a long spinning machine by either driving the drafting rolls separately at both ends, in which arrangement the drafting rolls can be divided all the way or at the middle of the machine, as e.g. shown in U.S. Pat. No. 3,339,361 or by interconnecting the rolls at least in pairs via separate toothed gear drives, as shown in German DE-OS No. 26 41 434. All these proposed arrangements are suitable for avoiding the undesirable distortion of the rolls; they show, however, substantial disadvantages. Thus, they require a complete and exactly synchronous double drive for the drafting rolls. This solution is expensive, and still more important, it implies, at least in an arrangement using continuous rolls, a very dangerous source of errors. If the draft ratio in the main drafting zone, which is to be adapted by correspondingly choosing gears (draft change gears) or similar elements, due to operator's error is not set to the same value at both side, torsion-forced breakage of one of the rolls inevitably occurs. This solution thus requires highest attention of the operating personnel and thus runs contrary to the intentions of the spinning mills of facilitating easy and error-free operation of the spinning machine.

SUMMARY OF THE INVENTION

It thus is an object of the present invention to eliminate the mentioned disadvantages of the known solutions, and in particular to propose a drive for the drafting arrangement rolls of the above mentioned type, in which the continuous drafting arrangement rolls of the main drafting zone cannot mutually distort backward during the standstill of the machine, without requiring the rolls to be driven at both ends, or to be mutually interconnected.

This object is achieved, using a drive of the above mentioned type, by providing at the other end of the drafting arrangement rolls second, slippage-free transmission elements comprising a freewheel clutch, the ratio of rotational speeds of which elements is lower than the ratio of rotational speeds determining the draft ratio, which during normal operation of the machine permit either running behind or lag of the faster running roll or a lead of the slower running roll of the drafting arrangement, and which during the standstill of the faster running roll of the drafting arrangement effect a slippage-free connection via the transmission elements.

This solution achieves the result that, upon reaching machine standstill and upon release of load in the drafting arrangement, the determined torsion of the drafting arrangement roll built up during the operation of the machine, and in particular the input roll of the main drafting zone, which is strongly distorted in the lagging sense cannot distort back, but that the distortion is maintained also after the forces generating it (friction in the bearings, drafting forces) are released. This is achieved since during the standstill of the machine the drafting arrangement rolls at both ends are mutually interconnected slippage-free drive wise, namely on one end by the actual drafting arrangement gear drive, i.e. by the first slippage-free transmission elements, and on the other end by the second slippage-free transmission elements which, via the now activated freewheel clutch, are rigidly coupled drivewise. It is particularly advantageous that coupling of the rolls always is effected automatically at the exact moment at which the rolls stop, independently of the ratio of rotational speed prevailing between the rolls, determined by the first slippage-free transmission elements, i.e. independently of the drafting ratio. From this advantage results, that if the drafting ratio in the main drafting zone is changed, the operating personnel are not required to take care of the second slippage-free transmission elements at the other end of the rolls, a very dangerous source of errors thus being eliminated.

It has proven to be advantageous to choose the ratio of rotational speeds of the second slippage-free transmission elements just slightly lower than the ratio of rotational speeds of the first slippage-free transmission elements determining the minimum draft ratio chosen for the spinning machine. This measure ensures that the difference in rotational speeds to be overcome in the idling direction is kept as small as possible, in such manner that also the wear of the freewheel clutch is kept to a minimum. Furthermore, the proposed solution also proves advantageous with respect to the small play always present in slippage-free transmission elements (e.g. the play of the gear tooth flanks, if such transmission elements are provided), as defects caused by the backward distortion due to said play are kept to a minimum.

According to an alternative design example of the inventive drive the slower running roll of the drafting arrangement, i.e. the input roll of the main drafting zone, can be connected at its end provided with the second slippage-free transmission elements, with an element distorting the roll in the sense of its normal rotation using a second freewheel clutch, in such manner that the second freewheel clutch does not impair the rotation of the drafting arrangement roll during its normal operation, as it is overhauled, whereas during the standstill of the machine it effects the slippage-free connection.

Owing to this arrangement it is possible to eliminate the higher distortion of the slower running roll caused during the start-up of the machine by the higher static friction compared to the sliding or dynamic friction. Due to the higher static friction or due to the higher "breaking loose resistance" of the roll respectively, the slower running roll tends to lag behind with respect to the faster running roll, caused by a distortion in addition to the one suffered during the normal operation of the machine, i.e. it is rotated only after a certain time lag. This again causes a drafting defect, which depending on the distortion, is higher the longer the distance from the drive of the rolls is, e.g. the longer the rolls are. Even if this additional distortion of the slower running rolls is levelled out again immediately after the "breaking loose" of the rolls, it still can cause yarn breakages. It is possible for the slower running roll of the drafting arrangement at its end, at which the second transmission elements are arranged, to be connected via a second freewheel clutch with an element forcing the roll in its normal direction of rotation, and that the second freewheel clutch during the normal operation of the machine does not impair the rotation of the roll of the drafting arrangement whereas during the standstill of the machine it effects the slippage-free connection. By virtue of these it can be achieved, that the slower running drafting roll during the start-up of the machine is always pulled, so to speak towards the faster running roll at the stop, in such manner that it "breaks loose" always simultaneously with the faster running roll. The drive arrangement with the second freewheel clutch thus has the function of eliminating the effect of the difference between static friction acting on the slower running roll and the faster running roll and of ensuring that both rolls are started always synchronously. This measure, however, is only required, if the above mentioned difference in the effect of static friction is practically effective in the inventive drive, which depends to a large extent on the bearing type used.

BRIEF DESCRIPTION OF THE DRAWINGS

The inventive drive is explained in the following in more detail with reference to illustrated design examples. There is shown in FIG. 1: a schematic, partially perspective view of a ring spinning machine with the inventive drive of the drafting arrangement rolls.

DETAILED DESCRIPTION OF THE PREFERRED EMBODIMENTS

Figure 1:
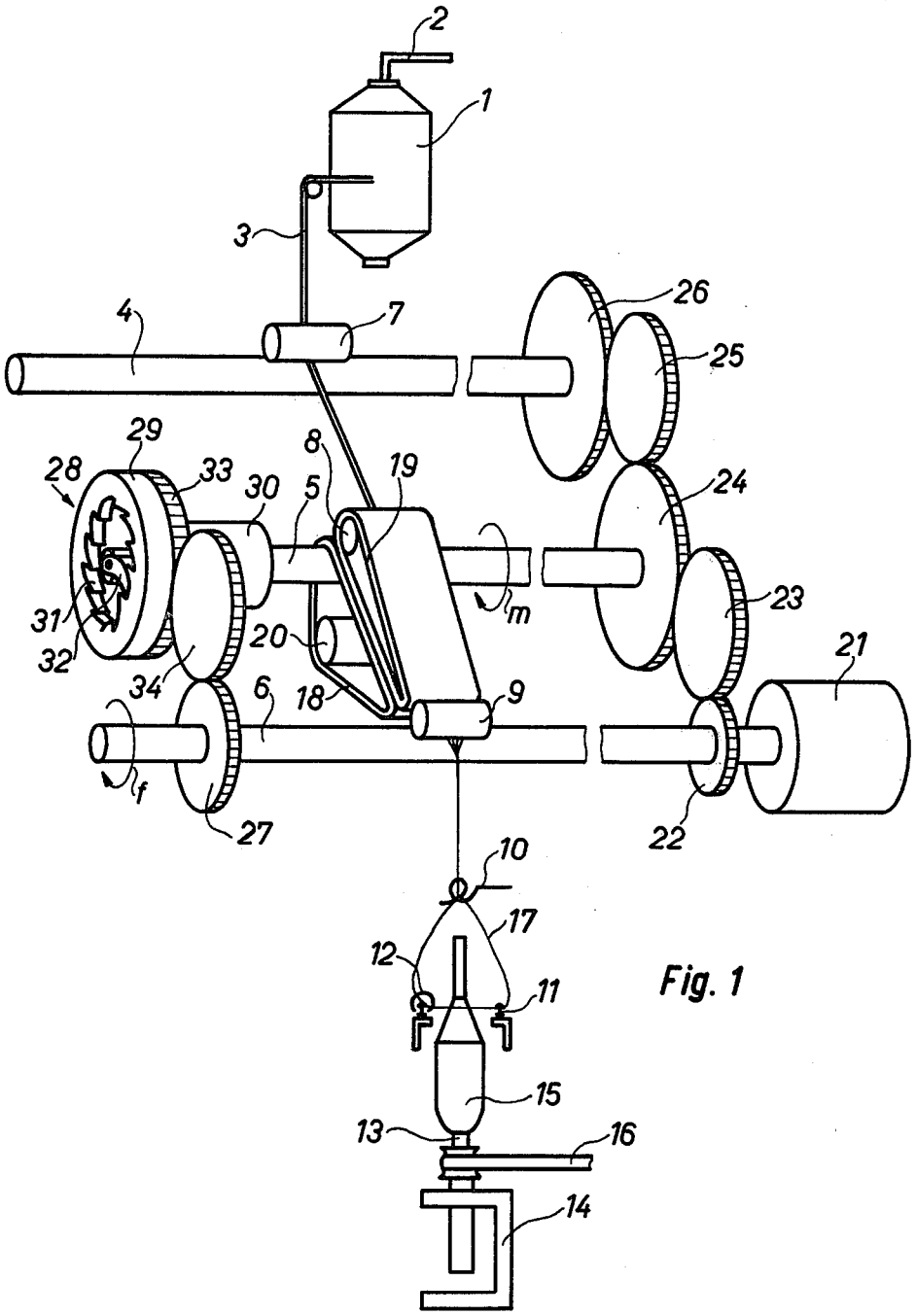

In FIG. 1 the elements of a spinning position of a ring spinning machine are shown schematically. They consist, as seen in the direction of material flow, of a roving bobbin 1 rotatably suspended from a rigid creel support 2, which supplies the roving 3 to be processed to a drafting arrangement. The drafting arrangement comprises three bottom rolls 4, 5 and 6 with corresponding pressure top rolls 7, 8 and 9. Arranged subsequently are a thread guide 10, a combination of ring 11 with a traveller 12 and a rotating spindle 13. The spindle 13 is rotatably supported in a ring rail 14 and supports a yarn bobbin 15, onto which the freshly spun yarn is wound, and is set into rotation by a belt 16.

The strand of fibres emerging from the pair of delivery rolls 6, 9 of the drafting arrangement, drafted to the required fineness is twisted in known manner under formation of a balloon 17 into a yarn and is wound onto the yarn bobbin 15.

The drafting arrangement comprises a first drafting zone (pre-draft zone) limited by the pairs of rolls 4, 7 and 5, 8 and a second drafting zone (main drafting zone), defined by the pairs of rolls 5, 8 and 6, 9. In the first drafting zone the roving 3 is drafted only slightly, e.g. 1 to 2 fold only, i.e. the difference in surface speed of the slower running rolls 4 and 7 with respect to the one of the faster running rolls 5 and 8 is small. Between the pairs of rolls 5, 8 and 6, 9 the fibre roving is drafted at a high draft ratio to the final yarn fineness. This second drafting zone thus is called the main drafting zone and the draft effected therein as a rule ranges between about 10 fold and 40 fold, in special cases up to 100 fold and more.

For better control of the fibre mass during the drafting operation in the main drafting zone as a rule so called double apron arrangements are used, here consisting of a bottom apron 18 surrounding the bottom roll 5 and of top apron 19 surrounding the top roll 8.

The bottom apron 18 as well as the top apron 19 are guided along the main drafting zone by suitable means (not shown) in FIG. 1 and are tensioned e.g. by tension rolls 20.

The fibre roving 3 now is guided between the legs or runs of the aprons 18 and 19 which are in mutual contact and are running parallel, in such manner that the fibre control required for high drafts is ensured. Such pairs of aprons 18, 19 are rotated only if considerable friction forces are overcome by the drive force of the driven roll 5 of the drafting arrangement. The roll 5 forms the input roll of the main drafting zone, whereas the roll 6 also is called delivery roll of the main drafting zone, or of the whole drafting arrangement, respectively. For simplified definitions the rolls 5 and 6 in the following description are referred to as the slower running roll and as the faster running roll, respectively, of the main drafting zone.

In a ring spinning machine referred to as long machine, about 250 spinning positions or more are lined up along one machine side. The rolls 4, 5 and 6 extending over all spinning positions of a machine side thus are of a length of about 18 to 35 m. For spinning technology reasons the diameter of the rolls 4, 5 and 6 is limited to a maximum of about 30 mm, and thus also their distortion resistance is relatively low.

The rolls 4, 5 and 6 of the drafting arrangement are driven from the right hand side by slippage-free transmission elements. The faster running roll 6 of the main drafting zone is directly driven by a motor 21 (sense of rotation according to arrow m).

The ratio of the numbers of teeth of the gears 24 and 22, the effective diameters of the rolls 5 and 6 being taken into account (and the thickness of the apron 18 on roll 5 also being taken into account) represents the drafting ratio in the main drafting zone. Of course, instead of gears also other slippage-free transmission elements, such as e.g. chains or toothed belts, can be applied. The important factor is just that the slower running roll 5 and the faster running roll 6 of the main drafting zone are interconnected by slippage-free transmission elements determining the drafting ratio.

The roll 4 of the drafting arrangement can be set into rotation e.g. from the slower running roll 5 of the main drafting zone also via slippage-free transmission elements, e.g. tooth gears 24, 25 and 26, in which gear train, according to the function of the pre-draft, the ratio of the numbers of teeth of the gears 26 and 24 is chosen small, normally in the range from 1 to 2. The rolls 4, 5 and 6 of the drafting arrangement are rotatably supported by a large number of bearings, not shown in FIG. 1, evenly distributed along the spinning machine.

For rotating the rolls 4, 5 and 6 the braking moments, generated by friction and causing a torque load on the roll, must be overcome. The slower running roll 5 is subject to a higher torque than the faster running roll 6, as the friction forces (e.g. generated by the apron assemblies) acting on it are considerably greater. Thus Also the distortion of the roll 5 is greater than that of roll 6, in such manner that as the torque moments acting onto the rolls disappear or are reduced (e.g. as the load on the pressing rolls 7, 8 and 9 is released), the slower running roll 5 tends to distort back in the direction of the arrow m more than the faster running roll 6. For preventing differing return-distortion of the rolls 5 and 6 during the standstill of the drafting arrangement, the rolls 5 and 6 are interconnected drive-wise at their free left hand side ends via further slippage-free transmission elements in such manner, that this connection is established only during the standstill of the faster running roll 6, whereas it remains inactive during operation. This is achieved in that a gear 27 rigidly mounted on the roll 6 is provided. The roll 5, on the other hand is provided with a freewheel clutch 28, shown in FIG. 1 as a ratchet arrangement for the sake of clearer understanding. A freewheel clutch of such type furthermore consists of an outer housing 29, which is connected with a hub 30 supported freely rotatable in bearings (not shown) on the roll 5 and which is provided with teeth 31 inside for a ratchet 32. The ratchet 32 is pivotably supported on the roll 5 and engages with the inside teeth 31 of the freewheel clutch 28 in such manner, that the outer housing 29 can rotate freely relative to the roll 5 clockwise (as seen from the left hand side). Counterclockwise its freedom of rotation with respect to the roll 5 is blocked as the ratchet 32 engages with the teeth 31 on the inside, i.e. the clutch is engaged if rotated in this direction. The outer housing 29 furthermore is provided with a tooth gear 33 on its periphery, which via an intermediate gear 34 is engaged with the gear 27. In this arrangement the ratio of the numbers of teeth of the gears 33 and 27 always is lower than the one mentioned before which determines the draft ratio, between the gears 24 and 22. If a spinning machine is laid out for a determined range of draft ratios, it proves advantageous to choose the second mentioned ratio somewhat smaller than the one determining the lowest draft ratio for which the machine is laid out, in such manner that the arrangement can function at any draft ratio set at a given time. Adaption of the transmission ratio to the main draft ratio, however, can be envisaged for the second slippage-free transmission elements, e.g. by exchanging the gear 27.

The freewheel clutch 28, shown here as a ratchet arrangement with an inside ratchet, is not limited to this design type, however. A freewheel clutch of this type, chosen in FIG. 1 merely for the sake of simplicity, shows the disadvantage that it does not engage properly if the number of teeth is too small. For optimum functional reliability of the inventive drive a freewheel clutch with a small lost motion is to be provided, i.e. one which can engage at practically any position immediately.

The drive according to FIG. 1 now functions as follows:

During operation of the machine the outer housing 29 of the freewheel clutch is rotated clockwise by the gears 27, 34, 33 faster than the slower running roll 5 of the drafting arrangement, i.e. the freewheel clutch is disengaged. Before the rolls 5 and 6 come to a standstill they are still distorted, the distortion of the slower running roll 5 being greater than that of the faster running roll 6. Now after stopping, e.g. by releasing the load on the pressure rolls 8 and 9, the friction forces acting onto the rolls 5 and 6 are diminished. Thus the rolls 5 and 6 tend to reduce their distortion, i.e. the roll 5 tends to distort back over a limited amount more than the roll 6 clockwise. This movement, however, of the roll 5 is blocked, as the ratchet 32 immediately engages with the inside teeth 31 of the freewheel clutch 28. The outer housing 29 thus also is driven clockwise for a limited rotation and tends to transmit this movement via the gears 33, 34, 27 to the stopped roll 6 of the drafting arrangement. The rolls 5 and 6 defining the main drafting zone thus are interconnected at both ends during the standstill of the machine via slippage-free transmission elements: and any relative rotation of the rolls, which would result in a drafting defect upon restarting the machine, is excluded.

As soon as the spinning machine is started up again the blocking action of the freewheel clutch 28 is released, as its outer housing 29 leads the slower running roll 5, i.e. rotates faster in the same direction than the roll 5.

Figure 2:
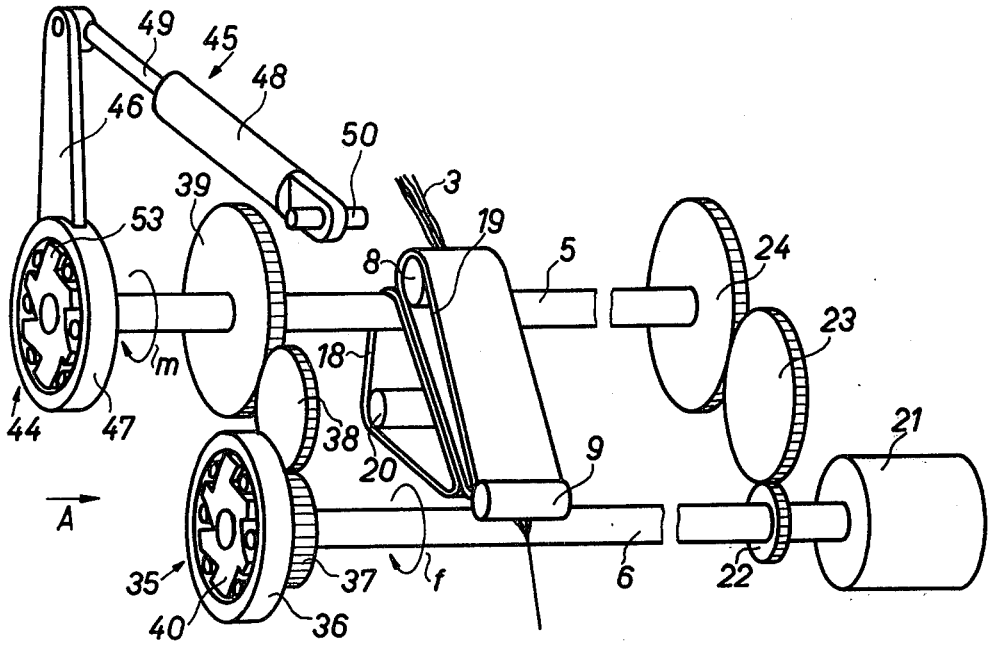
FIG. 2: a simplified, perspective view of an alternative design example of the drive.
Figure 3:
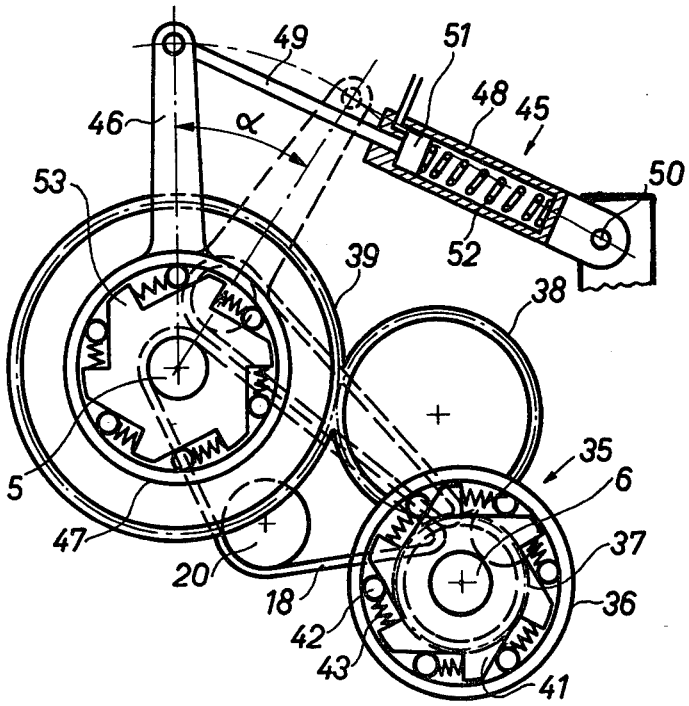
FIG. 3: the drive according to the alternative design example shown in FIG. 2, seen in the direction of arrow A of FIG. 2.

In FIGS. 2 and 3, in which the elements identical with the ones shown in FIG. 1 are designated with the same reference numbers, an alternative embodiment of the inventive drive is shown, which differs from the one shown in FIG. 1 only in that here the freewheel clutch 35, the function of which corresponds to the clutch 28 of FIG. 1, is arranged on the faster running roll 6 of the drafting arrangement. For simplifying the drawing, only the two rolls 5 and 6 defining the main drafting zone of the drafting arrangement are shown. In FIG. 2 a perspective view of the drive similar to the view illustrated in FIG. 1 is shown, whereas in FIG. 3 the drive according to FIG. 2 is shown as seen in the direction of arrow A.

In this alternative design example the freewheel clutch 35 is designed as a so called roller blocking arrangement with spring type friction elements, i.e. a freewheel clutch which can engage practically without any lost motion.

A roller blocking arrangement of this type consists of an outer ring 36, which is rigidly connected with a concentrical gear 37 and is supported freely rotatable in bearings not shown on the roll 6 of the drafting arrangement.

The gear 37 meshes with an intermediate gear 38 which is engaged with a gear 39 rigidly mounted on the slower running roll 5, and also in this arrangement the ratio of the numbers of teeth of the gears 39 and 37 is chosen smaller than the corresponding ratio of the gears 24 and 22, i.e. is smaller than the main draft.

On the roll 6 a star wheel 40 is rigidly mounted and arranged within the hollow interior of the outer ring 36, which star wheel 40 is provided with teeth 41 (FIG. 3) pivoted in the clockwise sense. Between the teeth 41 rollers 42 are inserted which are pressed by springs 43 into the wedge-shaped chambers formed between the tooth intervals and the outer ring 36. A roller blocking arrangement of such type, which is commercially available, permits free rotation of the starwheel 40 with respect to the outer ring 36 in one direction, in the example shown in clockwise direction, in the outer direction, however, any relative movement is blocked as the rollers 42 jam, the jamming becoming practically without any lost motion, as the rollers 42 are clamped immediately.

The function of this drive corresponds substantially to that of the drive described with reference to FIG. 1 and thus is not described in more detail. In this arrangement the slower running roll 5 when it comes to standstill tends to distort back clockwise with respect to the faster running roll 6 (always as seen from the lefthand side); this is blocked, however, by the action of the freewheel clutch 35, which immediately engages as its outer ring 36 is driven with respect to the star wheel 40 clockwise.

During the normal operation of the spinning machine the outer ring 36, owing to the transmission described, is rotated slower than the star wheel 40, or the faster running roll 6, respectively, i.e. the freewheel clutch runs behind the roll 6.

The alternative design example according to FIGS. 2 and 3 furthermore shows in which manner the slower running roll 5 of the drafting arrangement at its end, on which the second transmission elements 37 through 39 are arranged, via a second freewheel clutch 44, which is identical in its design with the freewheel clutch 35, is connected with an element 45, which distorts the roll 5 in the direction of its normal rotation, i.e. clockwise (as seen from the left hand side), in such manner that the freewheel clutch 44 during the normal operation of the machine does not impair the rotation of the roll 5 of the drafting arrangement, whereas it effects, as the machine comes to a standstill, the connection between the element 45 and the roll 5.

In the example shown in FIGS. 2 and 3 the element 45 consists of a lever 46, which is rigidly connected to the outer ring 47 of the freewheel clutch 44 and a pneumatic cylinder 48, the piston rod 49 of which is pivotably connected with the other end of the lever 46.

The cylinder 48 is pivotably supported on an axle 50 which is fixed relative to the room. The piston rod 49 is held during the operation of the spinning machine in its lefthand side position (shown with solid lines in FIG. 3) by a pressure spring, as the piston 51 is not subject to pressure. In this position the outer ring 47 of the freewheel clutch 44 thus remains at a standstill, whereas its star wheel 53 freely rotates clockwise together with the roll 5.

The additional device described here merely serves for overcoming the static friction forces acting upon the slower running roll 5 of the drafting arrangement during the startup phase of the spinning machine.

The additional device functions as follows: Before the spinning machine is started up the pneumatic cylinder 48 is pressurized. The piston 51 with its piston rod 49 now tends to rotate the lever 46 clockwise. As the slower running roll 5 still is at standstill, the freewheel clutch 44 is engaged. The lever 46 thus generates a torque moment in clockwise direction (as seen from the left) acting onto the roll 5. The spinning machine now is started up and the static friction forces acting upon the rolls of the drafting arrangement are to be overcome. This is effected by the torque moment mentioned which acts from the freewheel clutch 44 onto the slower running roll 5 and transmitted via the gears 39, 38 and 37 and the freewheel clutch 35, also acts onto the faster running roll 6, which torque moment is to be considered as "breaking loose" moment. In this process the lever 46 is rotated over the angle $\alpha$ to the stop of the piston 51 (position of the lever 46 indicated with broken lines in FIG. 3). As the start-up of the spinning machine is completed, or as the lever 46 rests against its right hand side stop, the freewheel clutch 44 is overtaken by its star wheel 53, in such manner that the rotational connection between the drive element 45 and the roll 5 of the drafting arrangement is released.

The pneumatic cylinder 48 in this arrangement can be activated independently in time from the spinning machine, i.e. it can be activated at any time during the standstill of the machine. This, because the torque moment exerted onto the roll 5 of the drafting arrangement, owing to the inventive blocking of the roll 5 during the standstill of the machine, cannot result in any distortion of the roll 5 in this direction. The torque moment however, is always available immediately for the start-up of the machine. The dimensions of the components of the element 45 (diameter and lift of the pneumatic cylinder 48, pressure in the cylinder, position of the lever 46, etc) depend on the static friction forces to be overcome and are chosen according to experiment.

While there are shown and described present preferred embodiments of the invention, it is to be distictly understood that the invention is not limited thereto, but may be otherwise variously embodied and practiced within the scope of the following claims. Accordingly,

What we claim is:

1. A drive for the driven drafting rolls of a drafting arrangement of long spinning machines, wherein the drafting rolls extend over an appreciable part of the length of the machine, especially for ring spinning machines, the driven drafting rolls of the drafting arrangement being arranged at the same longitudinal side of the spinning machine, comprising:

said driven drafting rolls defining a main drafting zone for a fiber sliver which is to be drafted and containing a faster running roll and a slower running roll;

said drafting rolls having opposed ends;

first substantially slippage-free transmission elements for mutually connecting said drafting rolls at their one opposed ends and for effectuating a ratio of rotational speeds of said drafting rolls in order to determine a predetermined draft ratio for said fiber sliver;

second substantially slippage-free transmission elements provided for the other opposed ends of the drafting rolls defining said main drafting zone;

said second slippage-free transmission elements containing a freewheel clutch;

said second slippage-free transmission elements having a rotational speed ratio lower than the ratio of the rotational speeds determining said draft ratio;

said second slippage-free transmission elements, during normal operation of the spinning machine, selectively allowing either the faster running one of the drafting rolls of the main drafting zone to lag or the slower running drafting roll of the main drafting zone to lead; and said freewheel clutch during standstill of the faster running roll effecting a slippage-free connection between the slower running roll and the faster running roll via the said second slippage-free transmission elements.

2. The drive as defined in claim 1, wherein:

said second substantially slippage-free transmission elements have a ratio of their rotational speeds which is merely lower by a small amount than the ratio of rotational speeds of the first slippage-free transmission elements which determine a minimum draft ratio of the spinning machine.

3. The drive as defined in claim 1, wherein:

said second slippage-free transmission elements comprise toothed gears which mutually mesh with one another essentially free of play.

4. The drive as defined in claim 1, wherein:

said slower running roll of the drafting arrangement has an end at which there is arranged the second slippage-free transmission elements;

means for forcing the slower running roll into a predetermined normal direction of rotation.

a second freewheel clutch for connecting said slower running roll at said end with said forcing means;

said second freewheel clutch during normal operation of the spinning machine operating such as not to impair the rotation of the slower running roll of the drafting arrangement whereas during standstill of the spinning machine said second freewheel clutch effects a slippage-free connection of said slower running roll with said faster running roll.

5. The drive as defined in claim 4, wherein:

said forcing means comprise a lever;

said lever having opposed ends;

a pneumatic piston-and-cylinder unit;

one end of said lever being operatively connected with said second freewheel clutch; and the other end of said lever being operatively connected with the piston of said pneumatic piston-and-cylinder unit.

* * * * *